United States Patent [19]

Stempin

[11] Patent Number: 4,907,712

[45] Date of Patent: Mar. 13, 1990

[54] TANK STABILIZER

[76] Inventor: David R. Stempin, 847 Warwick Drive, Burlington, Ontario, Canada, L7T 3Y4

[21] Appl. No.: 375,457

[22] Filed: Jun. 28, 1989

Related U.S. Application Data

[63] Continuation-in-part of Ser. No. 246,079, Sep. 19, 1988.

[51] Int. Cl.[4] ..... B65D 7/00

[52] U.S. Cl. ..... 220/69

[58] Field of Search ..... 220/69, 85 H, 85 K, 220/3

[56] References Cited

U.S. PATENT DOCUMENTS

| | | | |
|---|---|---|---|
| 2,489,766 | 11/1949 | Ernestus et al. | 220/69 |
| 2,683,579 | 7/1954 | Wallace | 220/69 X |
| 2,905,351 | 9/1959 | Lerner | 220/69 X |
| 3,028,702 | 4/1962 | St. Cyr | 220/69 X |
| 3,735,895 | 5/1973 | Roper | 220/69 X |
| 3,840,141 | 10/1974 | Allom et al. | 220/69 X |
| 4,573,597 | 3/1986 | Adams et al. | 220/69 X |

*Primary Examiner*—Steven M. Pollard

*Attorney, Agent, or Firm*—McConnell and Fox

[57] ABSTRACT

A stabilizer for a small gas cylinder consisting of a plastic cone which fits over the lower end of the cylinder and firmly grips the cylinder wall and provides an extended base which stabilizes the cylinder in its upright position.

8 Claims, 3 Drawing Sheets

TANK STABILIZER

REFERENCE TO RELATED APPLICATIONS

This application is a continuation-in-part of application No. 246,079 filed Sept. 19, 1988 by David R. Stempin.

FIELD OF THE INVENTION

This invention relates to means for stabilizing tanks containing pressurized gases.

DESCRIPTION OF THE PRIOR ART

Pressurized gases are normally stored in cylindrical tanks having a bottom end on which they normally stand and an upper end to which the outlet valve is attached. In many cases these tanks are tall and slim and when in use are normally supported by a suitable frame. However, in the case of propane tanks, particularly small propane tanks, designated as 20 pound tanks, the tank is still cylindrical but is almost spherical. It is provided with a foot in the form of an annulus attached to the lower portion of the tank. These small propane tanks are quite commonly transported, either for refilling or from place to place for supplying gas barbeques or on job sites where they are used, for example, by plumbers and roofers to provide suitable work heat or by other tradesmen for use as local heaters. In these cases, the tank may be stood on its foot and suitable controls, valves, etc. attached to the upper outlet of the tank. In any of these situations, whether being transported or being used with heating equipment attached to the upper end, the tank is not very stable since the annular collar mounted on the lower end of the tank is substantially smaller than the outer diameter of the tank. In some cases this is of no importance, but if the tank is being transported it is essential that it be stabilized so that it cannot inadvertently fall over. Similarly, when in use with heating equipment directly attached to the tank, particularly in outdoor locations, some means must be provided for stabilizing the tank.

In the past, one solution to this problem has been to suitably form a corrugated cardboard box which snugly fits the tank, and extends part way up the cylinder. Naturally, if the box is square, it will be necessary to either have the box fit the cylinder so snugly that the sides of the cylinder engage the sides of the box, or folded portions of the box can fill in the corners and help to stabilize the tank. It is evident, however, that this solution is at best temporary. A corrugated box when subjected to travel soon loses its shape and particularly if it is also subjected to moisture, as in a case where the tank is being used as a portable heat source. If the corrugated cardboard container softens and the tank rolls over, it may be extremely hazardous, particularly in locations where the user is operating, for example, on a building site surrounded by flammable materials. Because of variations in cylinder diameter as much as one half inch, it is also difficult to provide a box which snugly fits all cylinders. It is, therefore, the purpose of this invention to provide an improved tank stabilizer which is reusable, sturdy and sufficiently weatherproof to permit outside use.

SUMMARY OF THE INVENTION

In accordance with the present invention, a tank stabilizer is provided which consists of a truncated cone of water resistant resilient material, the upper end of which resiliently engages walls of a tank and whose lower end is of greater diameter than its upper end and, when in place on the cylinder, extends outwards beyond the periphery of the cylinder.

A clearer understanding of my invention may be had from a consideration of the following description and drawings.

DESCRIPTION OF THE PREFERRED EMBODIMENT

Figure 1:
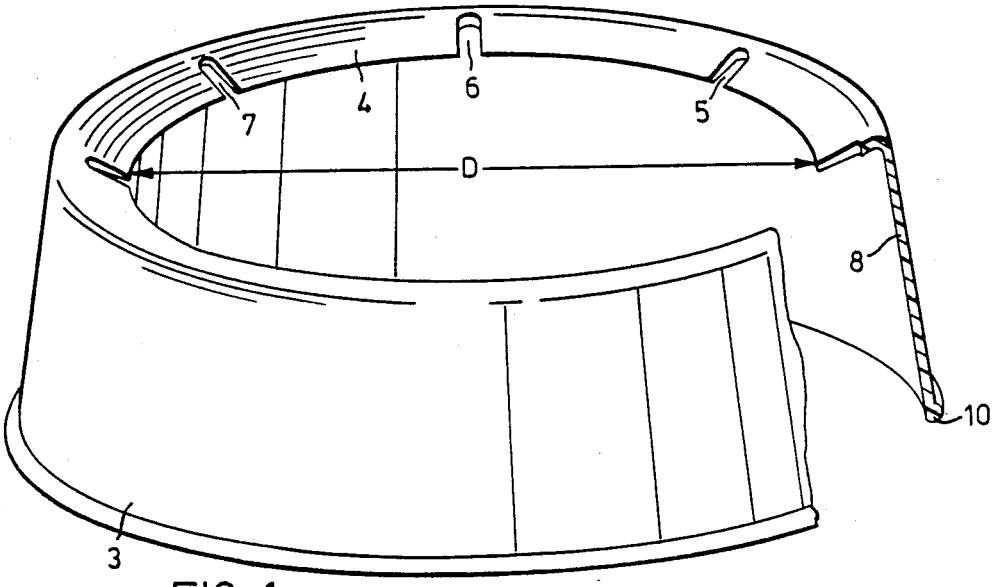
FIG. 1 is an isometric view of the stabilizer, partially in section.

As will be seen in FIG. 1, the stabilizer consists of a plastic cone-shaped member 3 having an upper inwardly turned lip 4 which projects downwards into the interior of the stabilizer. This lip 4 is also of conic section with its lower edge of less diameter than the upper diameter of the stabilizer. The lip 4 includes a number of serrations, 5, 6 and 7 which extend from the lower edge of the lip 4 to a point near the upper edge of the stabilizer.

Figure 2:
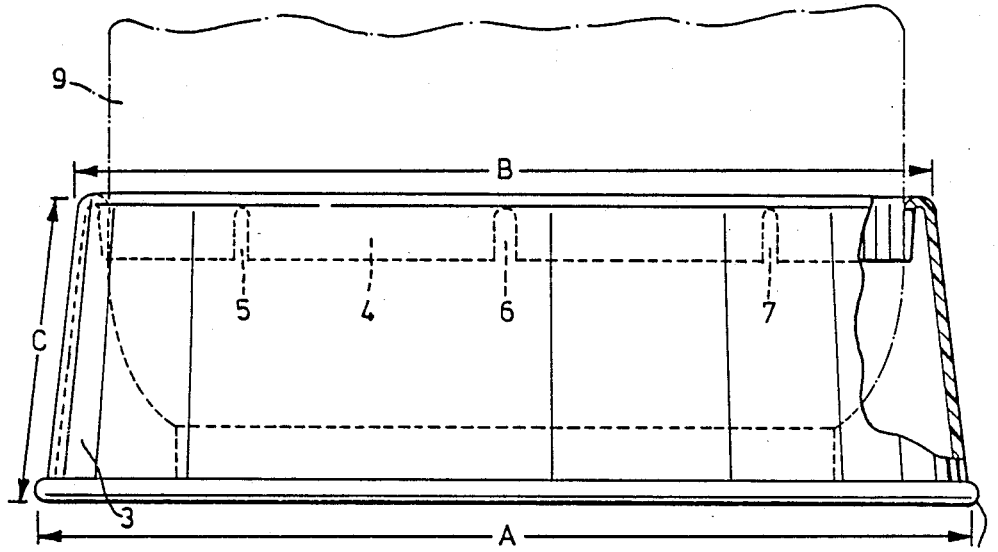
FIG. 2 is an elevational view, partly in section, of the stabilizer of FIG. 1 in place on a small propane tank.

As seen in FIG. 2, when the stabilizer is installed on a tank, the lip 4 is deflected by the outer walls of the tank. The lip is permitted to deflect by the serrations 5, 6 and 7 and their corresponding serrations on the other side of the stabilizer (which is not visible).

The lower edge of cone 3 is turned outwards to form a foot 10.

Figure 3:
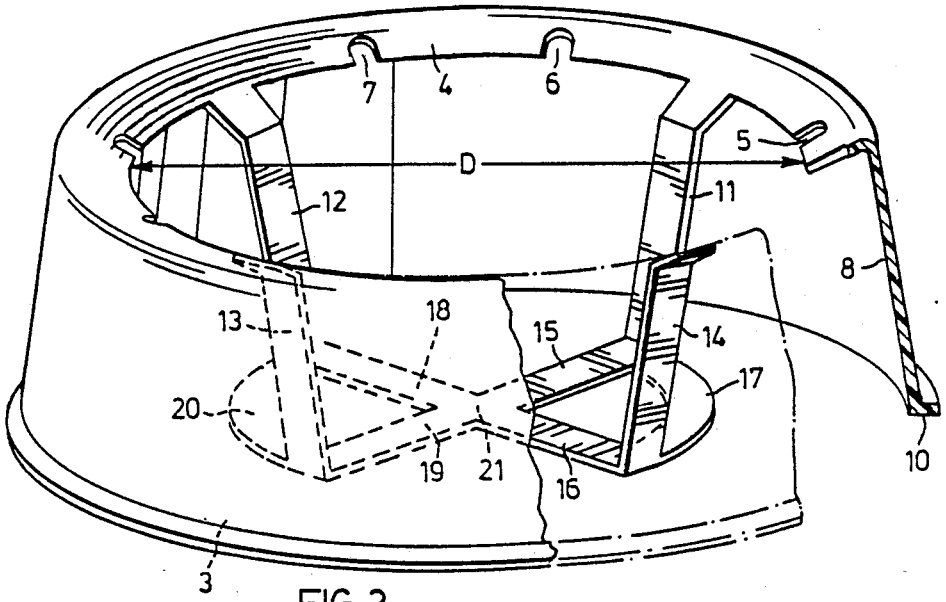
FIG. 3 is an isometric view of an alternative form of the stabilizer.

In the alternative form shown in FIG. 3, straps 11, 12, 13 and 14 depend down from lip 4. These straps are "L" shaped with the lower end of the straps interconnected by a structure which may be described as a cruciform with two pairs of legs of the cross joined by arcuate sections. Legs 15 and 16 joined by straps 11 and 14 respectively are themselves joined by arcuate section 17. Similarly legs 18 and 19 joined to straps 12 and 13 are connected by arcuate section 20. All four legs meet at the centre 21.

Figure 4:
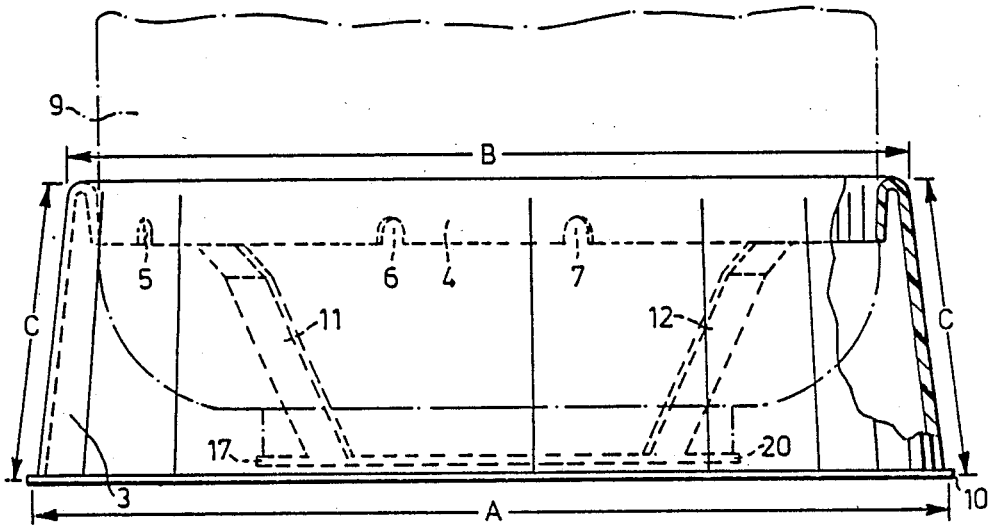
FIG. 4 is an elevational view, partly in section, of the stabilizer of FIG. 3.

As may be seen in FIG. 4, the foot of the cylinder sits on arcuate members 17 and 20 when installed.

Figure 5:
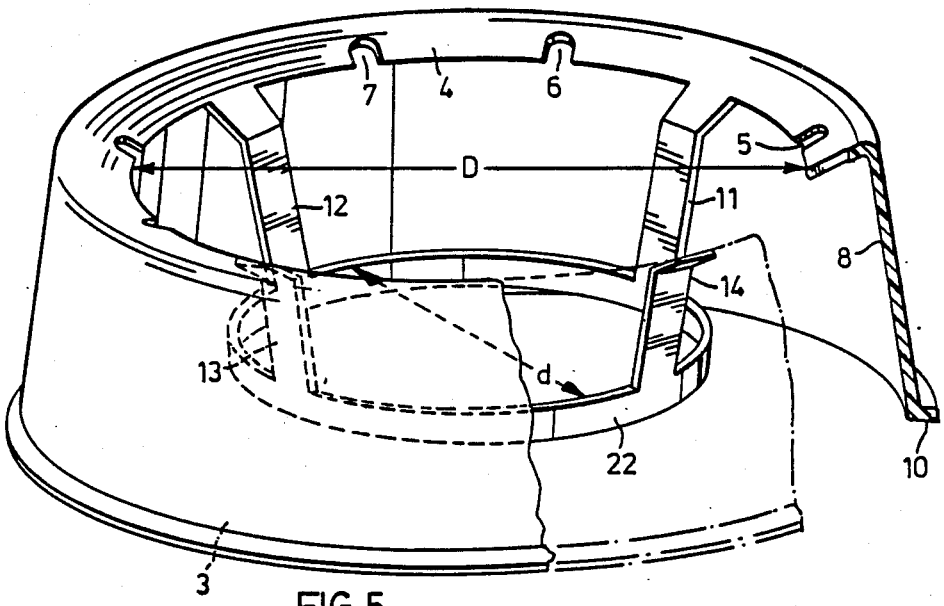
FIG. 5 is an isometric view of an alternative form of the stabilizer.

In the alternative form shown in FIG. 5, straps 11, 12, 13 and 14 are joined to a common ring member 22 at their lower ends. The ring member has a minimum diameter "d".

Figure 6:
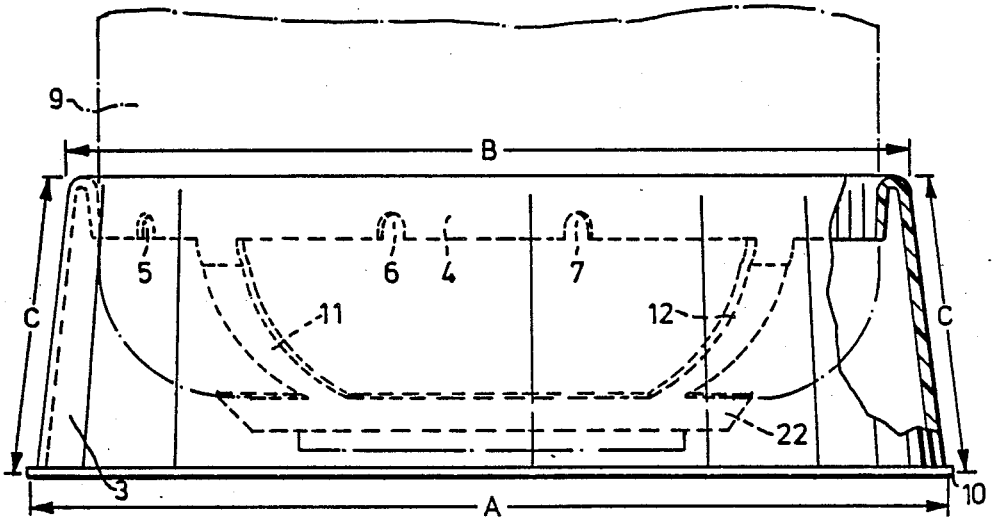
FIG. 6 is an elevational view, partly in section, of the stabilizer of FIG. 5.

As may be seen in FIG. 6, the foot of the cylinder 9 passes through the ring member when installed and the ring member bears against the curved lower surface of the cylinder.

In order to perform the function in a suitable manner, several aspects must be considered. First the material of the stabilizer must be suitable; a tough, resilient plastic such as polypropylene or polyethylene will be found to be satisfactory. The thickness of the wall 8 must be sufficient to provide the strength necessary to support the tank and, depending upon the stiffness of the plastic, will be in the neighbourhood of about one-eighth of an inch.

When used with a standard 20, 30 or 40 pound propane tank, the following dimension will be found to be satisfactory. The base diameter A should be approximately 15 inches, the upper diameter B, across the top edge of the stabilizer, will be 13.75 inches, the lip 4 will extend one inch from the upper edge at an angle of about 60° with respect to the outer wall 8 resulting in an inner diameter D across lip 4 of approximately 11.875 inches, that is about 15–16% less than B. The length of the cone C, that is from its lower edge to its upper edge, will be in the neighbourhood of 4½ inches.

It will be evident that some of these dimensions may be largely a matter of choice, for example, length may vary and the lower diameter may vary, however, it has been found that with a standard propane tank, the dimensions suggested provide the necessary stabilization so that when properly installed the stabilizer permits the tank to be transported or used with minimal probability of the tank tipping over and the diameters are such that the stabilizer remains on the tank when the tank is lifted.

The dimensions suggested relate to standard 20, 30 and 40 pound tanks which are the common sizes, and the stabilizer of the form shown has been found to perform satisfactorily, however, there are smaller tanks such as the 5 and 10 pound propane tanks where the dimension will have to be quite different but they may be deduced from the dimension used for the 20, 30 and 40 pound tanks.

It is not suggested that this stabilizer will provide suitable stabilization for other large cylinders, such as fullsized oxygen cylinders or other compressed gas cylinders, since their height to diameter ratio are such as to make it impossible to stabilize them simply by standing them on their end, even when an extended base is provided by a stabilizer.

As is seen in FIG. 2, the stabilizer 3 is pressed onto the end of the cylinder 9 causing the lip 4 to be deflected as the serrations 5, 6 and 7 are extended. The lip 4 firmly grips the cylinder 9 and when completely installed the base of the cylinder and the base of the stabilizer are in the same plane, as shown. If, on the other hand the surface on which the cylinder is standing is not flat, as may frequently be the case, the open bottom of the stabilizer permits the cylinder to be raised or lowered in the stabilizer to ensure maximum contact of the stabilizer and cylinder base with surface, thus maximizing stability. It will be evident that a box with a closed bottom will not permit such adjustment. Because of the much greater diameter of the stabilizer than the foot of the cylinder, it is evident that with the stabilizer installed the cylinder will be much more stable than if standing solely on its own foot.

When it is necessary to remove the stabilizer, the user can grip it with his feet over the edge of foot 10 and pull the cylinder up and out of the stabilizer. The foot 10 provides additional rigidity to the stabilizer minimizing deflection of the walls and also provides a larger bearing surface when the tank is placed on a soft material such as wet earth.

In the alternate form shown in FIGS. 3 and 4, the straps 11, 12, 13 and 14 are deflected as the cylinder is inserted and, while the bottom of the stabilizer is not open as in the previous example, it is adjustable, as the foot of the cylinder bears down on the arcuate sections 17 and 20 further deflecting the straps. The arcuate portions prevent the foot of the cylinder from cutting through the straps 11, 12, 13 and 14.

In the alternate form shown in FIGS. 5 and 6, the ring 22 is larger in diameter than the foot of the cylinder, as previously explained. The ring is a truncated cone or dish shaped at least partially conforming to the curvature of the cylinder. When the cylinder is inserted, the straps 11, 12, 13 and 14 deflect, the ring 22 engages the lower curved surface f the cylinder. The straps in this form are shorter than the straps in the previous alternate form and cause the ring 22 to engage the cylinder firmly but resiliently, permitting the cylinder to slide into the stabilizer to a depth determined by the contour of the surface on which the stabilized cylinder is sitting.

The addition of straps 11, 12, 13 and 14 produces an inward tension on the upper edges of the stabilizer causing it to grip the cylinder more firmly, as the lower portion of the cylinder forces the ends of straps down placing the straps in tension. At the same time, the straps themselves contribute to frictional engagement of the stabilizer and the cylinder and inhibit rotation of the cylinder in the stabilizer.

While described for use on 20, 30 and 40 pound tanks, it will be understood that the stabilizer will find its greatest use on 20 pound tanks, since the 30 and 40 pound tanks are more commonly installed in a rack, for example, in a recreational vehicle. However, where the larger tanks are used without other support, the addition of the stabilizer will be found to improve the stability of the tank.

I claim:

1. A stabilizer for a pressurized gas cylinder having a ring-shaped foot mounted on its lower curved end, said stabilizer comprising a hollow truncated cone-shaped member having the upper edge of its wall terminated in an inwardly projecting lip and the lower edge of its wall having a diameter greater than said cylinder, the said upper edge having a diameter slightly greater than said cylinder and the diameter of the edge of said lip having a diameter slightly less than the diameter of said cylinder including at least two flexible straps having first and second ends, connected to opposite edges of said lip by their said first ends and joined together at their said second ends, the length of said straps being such that, when the cylinder is inserted in said stabilizer, said straps engage the inserted end of said cylinder and suspend the said cylinder in said stabilizer.

2. A stabilizer as claimed in claim 1 including at least four straps joined at their said second ends at a common central point.

3. A stabilizer as claimed in claim 2 including arcuate members joining at least two adjacent straps at points proximate their said second ends.

4. A stabilizer as claimed in claim 3 wherein the inner edges of said arcuate members define at least a portion of a circle of diameter less than the diameter of said foot of said cylinder.

5. A stabilizer as claimed in claim 3 wherein said straps are "L" shaped resilient members.

6. A stabilizer for a pressurized gas cylinder having a ring-shaped foot mounted on its lower curved end, said stabilizer comprising a hollow truncated cone-shaped member having the upper edge of its wall terminated in an inwardly projecting lip and the lower edge of its wall having a diameter greater than said cylinder, the said upper edge having a diameter slightly greater than said cylinder and the diameter of the edge of said lip having a diameter slightly less than the diameter of said cylinder including at least two flexible straps having first and second ends connected to opposite edges of said lip by their said first ends and joined to a ring at their said second ends, said ring having an inner diameter greater than the diameter of the foot of said cylinder but less than the diameter of said cylinder whereby said ring engages the said lower curved end of said cylinder when said cylinder is inserted into said stabilizer.

7. A stabilizer as claimed in claim 6 wherein said straps are "L" shaped resilient members.

8. A stabilizer for a pressurized gas cylinder as claimed in claim 7 including at least four straps.

* * * * *